US005753878A

United States Patent [19]

Doughty et al.

[11] Patent Number: 5,753,878

[45] Date of Patent: May 19, 1998

[54] CIRCUIT BREAKER HAVING VARIABLE ARC GAS VENTING

[75] Inventors: Dennis J. Doughty, Plainville; Randall L. Greenberg, Granby; Ronald D. Ciarcia, Bristol, all of Conn.

[73] Assignee: General Electric Company, New York, N.Y.

[21] Appl. No.: 636,257

[22] Filed: Apr. 23, 1996

[51] Int. Cl.[6] ..... H01H 9/02; H01H 33/02

[52] U.S. Cl. ..... 218/157; 200/306

[58] Field of Search ..... 218/147–149, 218/154–157; 200/304–306; 335/201

[56] References Cited

U.S. PATENT DOCUMENTS

| | | | |
|---|---|---|---|
| 3,582,966 | 6/1971 | Strobel | 218/149 |
| 4,011,425 | 3/1977 | Gryctko | 218/149 |
| 4,581,511 | 4/1986 | Leone | 218/149 X |
| 4,620,076 | 10/1986 | Mrenna et al. | 200/304 |
| 4,631,376 | 12/1986 | Leone | 200/306 |
| 4,639,564 | 1/1987 | Grunert et al. | 218/156 |
| 4,650,940 | 3/1987 | Grunert et al. | 218/155 |
| 4,731,921 | 3/1988 | Ciarcia | 29/622 |
| 5,493,092 | 2/1996 | Rowe | 218/156 |
| 5,569,894 | 10/1996 | Uchida et al. | 218/157 X |
| 5,581,063 | 12/1996 | Clark et al. | 335/201 X |
| 5,589,672 | 12/1996 | Uchida et al. | 218/149 X |
| 5,608,198 | 3/1997 | Clark et al. | 218/149 X |

*Primary Examiner*—J. R. Scott
*Attorney, Agent, or Firm*—Richard A. Menelly; Carl B. Horton

[57] ABSTRACT

Circuit breaker arc exhaust apertures in the line end of the circuit breaker case transfer arc gases from the circuit breaker interior during overcurrent circuit interruption. A flexible shield protects the circuit breaker terminal lug from arc gas contamination.

10 Claims, 3 Drawing Sheets

CIRCUIT BREAKER HAVING VARIABLE ARC GAS VENTING

BACKGROUND OF THE INVENTION

Circuit breakers as described in U.S. Pat. No. 4,731,921 entitled "Method of Fabricating a Molded Case Circuit Breaker" are capable of interrupting circuit current over a wide range of ampere ratings. One of the limits, to still higher ampere ratings is the problems that occur with the venting of the arc gases that are generated during short circuit interruption. Larger arc chutes are correspondingly required to cool and quench the gases and to limit and control the amount of gas that is exited from the line end of the circuit breaker enclosure. It would be desirable to use the same circuit breaker components and enclosure over still higher ampere ratings without having to enlarge either the arc chute, current carrying components or the enclosure.

U.S. Pat. No. 3,582,966 entitled "Venting Means for Circuit Breaker Arc Quencher" describes a high ampere-rated circuit breaker that employs a flexible arc shield arranged intermediate the end of the arc chute and the apertures that vent the arc gases from the circuit breaker enclosure. The apertures are vented during so-called "long time" and "short time" overcurrent occurrences but become exposed during short circuit conditions by the forces generated by the arc gases during the short circuit interruption. The associated line terminal lug or terminal screw is situated under the vent apertures and is separated from the effluent gases by means of a line terminal compartment barrier. It would be economically advantageous to vent the effluent gases upon short circuit interruption at higher ampere ratings without having to limit the number of apertures by incorporating a line terminal compartment with in the circuit breaker enclosure to protect the associated line terminal screw.

One purpose of the invention is to enlarge the circuit interruption capacity of a circuit breaker without having to correspondingly increase the size of the circuit breaker components or the size of the enclosure.

SUMMARY OF THE INVENTION

A circuit breaker arc exhaust arrangement whereby a large number of apertures are provided in the line end of the circuit breaker case and cover for arc gas transfer out from the case and cover during overcurrent circuit interruption. A flexible shield is interfaced between the circuit breaker line terminal lug and the apertures to prevent contamination of the line terminal screw without diminishing the circuit breaker ampere interruption capacity.

DESCRIPTION OF THE PREFERRED EMBODIMENT

Figure 1:
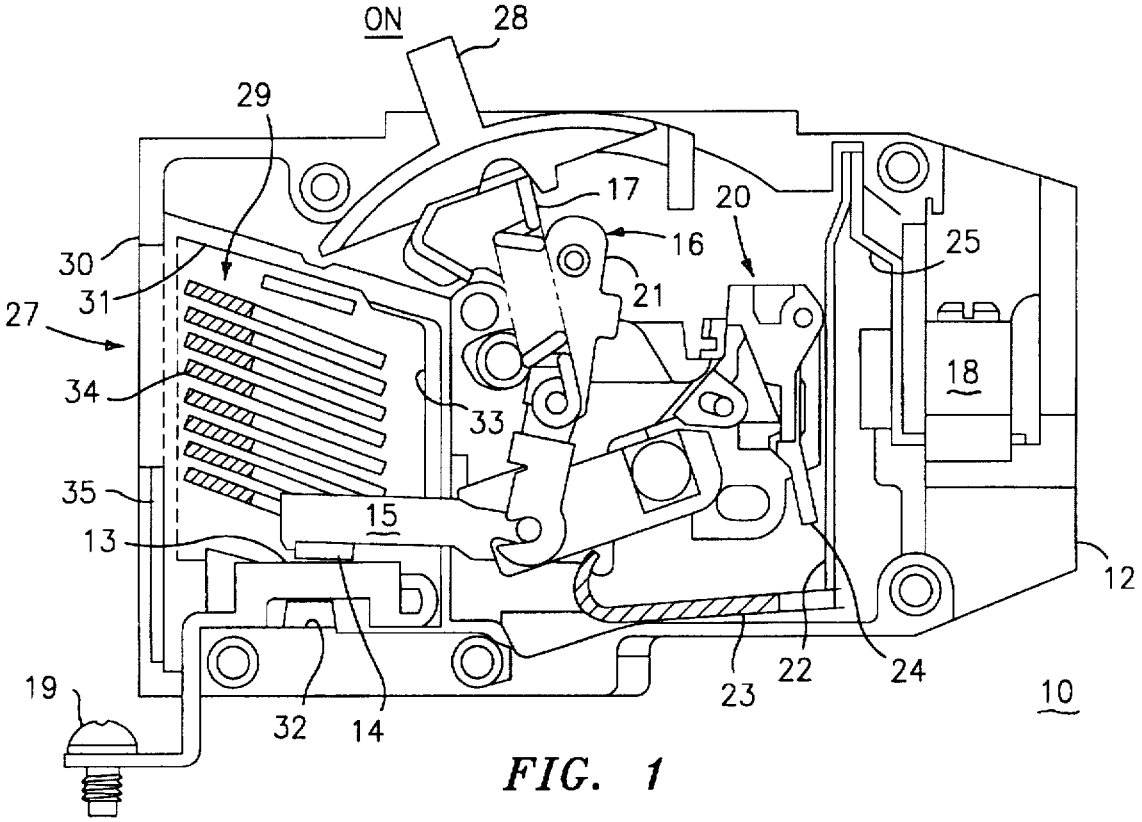
FIG. 1 is a side plan view of a circuit breaker with the cover removed to depict the holding slot provided for the flexible shield in accordance with the invention.

A molded case circuit breaker 10 is shown in FIG. 1 comprising a case 12 with the cover removed to show the interior components. The current carrying components include a fixed contact 13 and a movable contact 14 attached to an operating mechanism 16 by means of a movable contact arm 15. The operating mechanism is refrained from driving the movable contact arm and movable contact to the open position under the bias provided by a pair of powerful operating springs 17 by interference between the cradle 21 and the latch system 20. An explanation of the operation of the latch system is found in the aforementioned U.S. Pat. No. 4,731,921 entitled "Method of Fabricating a Molded Case Circuit Breaker". The load lug 18 is connected with an external poser distribution circuit such that circuit current transfers through a load strap 25 and bimetal 22 and from the braid conductor 23 to the movable contact arm 15 and contacts 13,14 to the line terminal screw 19. The bimetal 22 upon the occurrence of an overcurrent condition contacts the trip bar 24 to articulate the operating mechanism to separate the contacts. Upon the separation of the contacts, the arc that occurs therebetween is quickly extinguished within the arc chute 27 to completely interrupt the circuit current. The operating mechanism is separately controlled by means of an operating handle 28 depicted with the contacts 13, 14 in their "ON" condition. In accordance with the invention, the enclosure for the arc plates 29 is in the form of a front 30, top 31, bottom 32, and rear 33 integrally-formed with the case 12. The elongated slot 35 formed within the base accepts the deflector 36 shown in FIGS. 2–4 to block the apertures 34 formed in the front of the arc plate enclosure.

Figure 2:
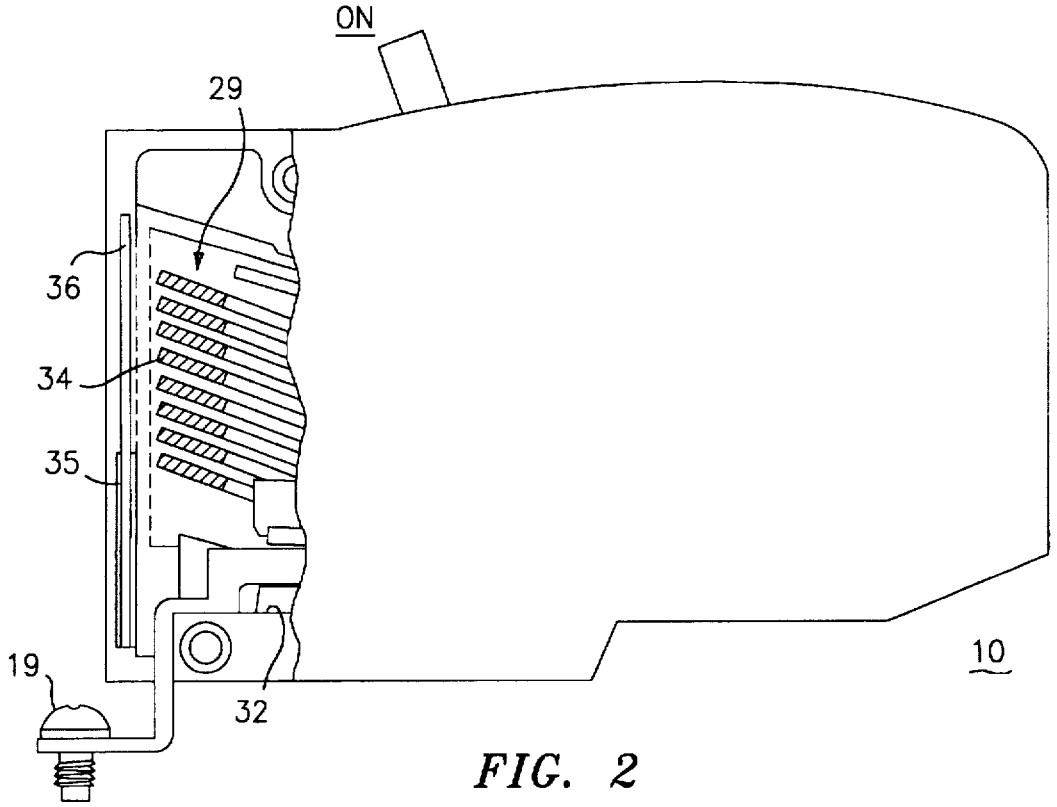
FIG. 2 is a side plan view of the circuit breaker of FIG. 1 with the cover partially removed to depict the flexible shield within the slot under quiescent current conditions.
Figure 3:
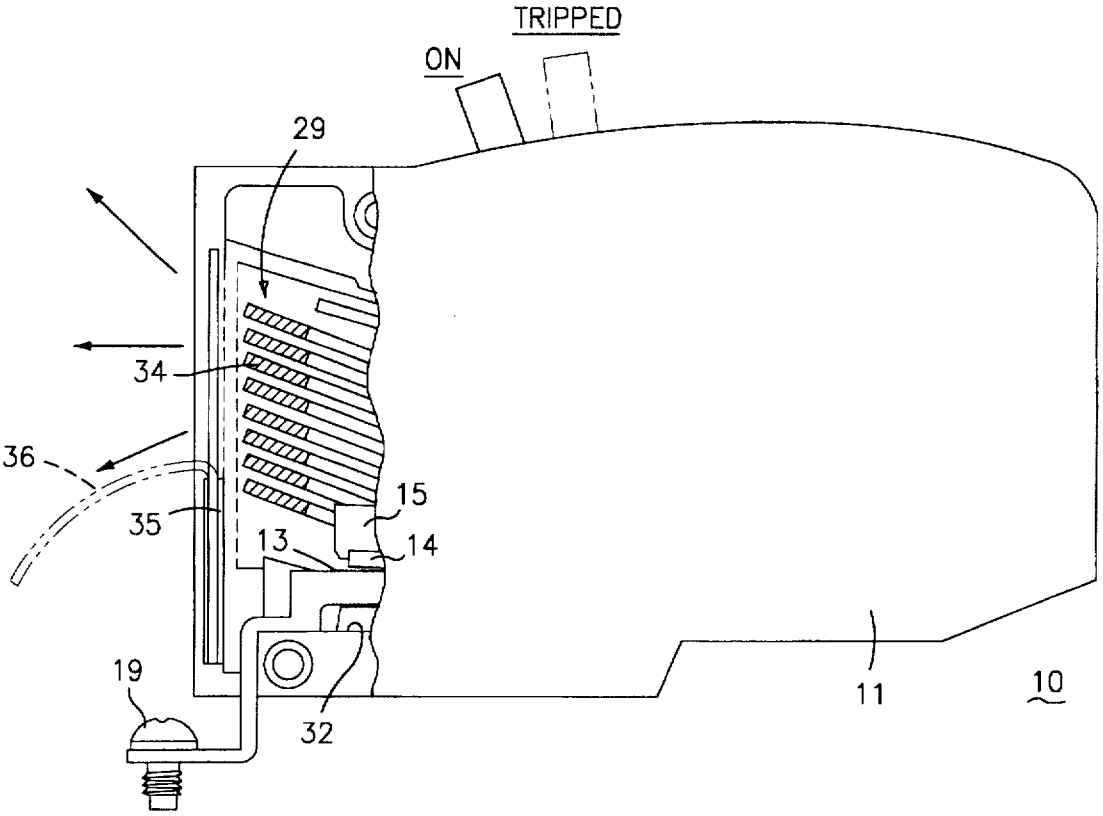
FIG. 3 is side plan view of the circuit breaker of FIG. 2 with the flexible shield within the slot under short circuit overcurrent conditions.

An important function of the deflector 36 is to protect the interior of the circuit breaker 10 from environmental conditions during quiescent operating conditions as indicated in FIG. 2, along with shielding the line terminal screw 19 during intense overcurrent conditions when copious arc gases must be released from the arc chamber. The circuit breaker 10 is shown in FIG. 3 with the contacts 13, 14 closed and the contact arm 15 in its closed position. Upon severe overcurrent conditions, such as a short circuit fault occurrence within the protected electrical distribution system, the contact arm moves to the phantom position resulting in the formation of an intense arc between the separated contacts 13, 14. The associated arc gases generate sufficient gas pressure to blow the deflector 36 to the phantom position to release the arc gases to the outside atmosphere. It is noted that the line terminal screw 19 is protected from the gases and hence is not subjected to deformation and welding as otherwise could occur. The deflector 36 is fabricated from a fibrous material such as Delrin, which is a trademark of DuPont Co. for a high-temperature fiber, although other heat-resistant resilient materials may also be employed. The mechanical memory of the fiber material allows the deflector to immediately return to the home position indicated in solid lines after the arc is cooled and quenched within the arc chute. Earlier flexible deflectors have been limited to a slight displacement from the home position by the positional relationship between the height of the elongated slot 35 and the location of the deflector within the slot.

Figure 4:
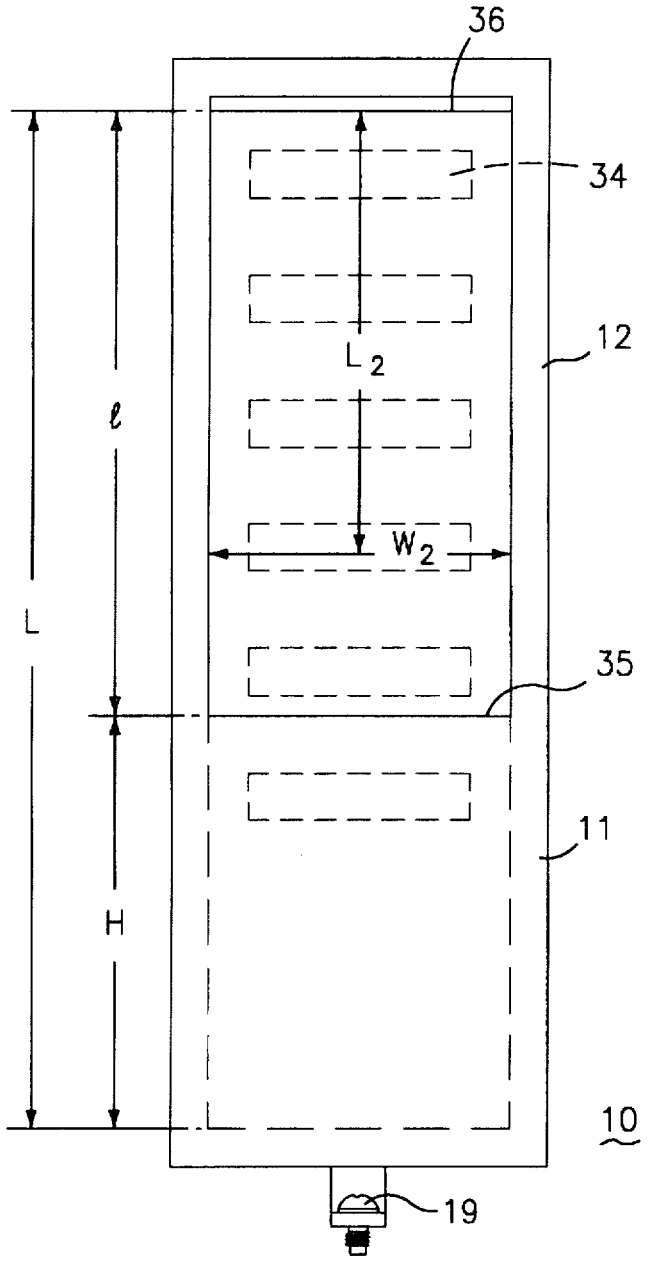
FIG. 4 is an enlarged end view of the circuit breaker of FIG. 2 detailing the dimension of the flexible shield relative to the dimension of the slot.

As best seen in FIG. 4, the line end of the circuit breaker 10 is shown in relation to the line terminal screw 19 to depict the positional relationship between the deflector 36 and the top of the elongated slot 35. The apertures 34 extend along the line end of the circuit breaker cover and case 11, 12 below the top of the elongated slot to provide the maximum egress to the arc generated gases, and the flex of the deflector is arranged to provide the corresponding maximum exposure to the apertures in the following manner. The length L of the deflector 36 is selected such that the top part I is greater than the height H of the elongated slot 35 as measured from the bottom of the cover and case. The center of gravity for the deflector 36 as viewed in the upright position, as shown in FIG. 4, is approximately located at half the width W/2 and half the height L/2 of the deflector 36 Accordingly, the top of the elongated slot 35, at H, should be below the center of gravity of the deflector 36 for maximum deflection to occur.

An inexpensive and simple arrangement has herein been described for allowing a circuit breaker to interrupt overcurrent conditions at increased ampere ratings without having to enlarge the circuit breaker arc chute and enclosure. The increase in the out-gassing facility at the higher interruption currents is provided by the corresponding increase in the rate of egress of the arc gases from the circuit breaker enclosure by means of a flexible deflector having mechanical memory and high temperature withstand properties.

We claim:

1. A variable gas venting arc chute for circuit interrupters comprising:

an arc chamber approximate one end of a circuit interrupter enclosure;

arc plates within said arc chamber for quenching and cooling an arc;

means provided at one end of said arc chamber for egress of gases generated upon circuit interruption; and a support within said enclosure at said one end for placement of a deflector external to said egress means, said deflector comprising an elongated strip of heat resistant material, said strip defines a first length and a first width adapted for placement within said support, said first length being greater than said first width, said support comprises an elongated slot integrally-formed within a circuit interrupter enclosure subjacent and external to said egress means, and said elongated slot terminates at a top part defining a second length extending from a bottom of said circuit interrupter enclosure.

2. The gas venting arc chute of claim 1 wherein said egress means comprise a plurality of apertures formed within said enclosure.

3. The gas venting arc chute of claim 1 wherein said elongated strip further defines a center of gravity at a location equal to half said first length of said elongated strip, said center of gravity being located above said top part of said elongated slot.

4. The gas venting arc chute of claim 1 wherein said circuit interrupter enclosure supports a line terminal screw external to and subjacent said elongated slot.

5. The gas venting arc chute of claim 4 wherein said elongated strip flexes toward said terminal screw upon venting of said arc gases, thereby shielding said terminal screw from said arc gases.

6. A circuit breaker comprising in combination:

a molded plastic case and a molded plastic cover;

a fixed and a separable contact within said case;

a movable contact arm within said case, said movable contact being attached to one end, said movable contact arm being arranged for moving said movable contact away from said fixed contact under the urgency of an operating spring upon occurrence of overcurrent conditions within a protected circuit;

a variable gas venting chamber proximate one end of a circuit interrupter enclosure;

arc plates within said arc chamber for quenching and cooling an arc generated between said fixed and separable contacts upon their separation;

means provided at one end of said arc chamber for egress of gases generated upon interruption of said contacts;

a support within said enclosure at said one end for placement of a deflector external to said egress means, said deflector comprising an elongated strip of heat resistant material;

said strip defines a first length and a first width adapted for placement within said support, said first length being greater than said first width, said support comprises an elongated slot integrally-formed within a circuit interrupter enclosure subjacent and external to said egress means, said elongated slot terminates at a top part defining a second length extending from a bottom of said circuit interrupter enclosure and said elongated strip is positioned within said elongated slot whereby said first length of said elongated strip is greater than said second length of said elongated slot.

7. The circuit breaker of claim 6 wherein said egress means comprise a plurality of apertures formed within said enclosure.

8. The circuit breaker of claim 6 wherein said elongated strip further defines a center of gravity at a location equal to half said first length of said elongated strip, said center of gravity being located above said top part of said elongated slot.

9. The circuit breaker of claim 6 wherein said circuit interrupter enclosure supports a line terminal screw external to and subjacent said elongated slot.

10. The circuit breaker of claim 6 wherein said elongated strip flexes toward said terminal screw upon venting of said arc gases thereby shielding said terminal screw from said arc gases.

* * * * *